US008154494B2

(12) United States Patent
Koide et al.

(10) Patent No.: US 8,154,494 B2
(45) Date of Patent: Apr. 10, 2012

(54) IMAGE DISPLAY DEVICE WITH LIQUID CRYSTAL MODULATION ELEMENTS

(75) Inventors: Jun Koide, Chuo-ku (JP); Masayuki Abe, Utsunomiya (JP); Yuya Kurata, Utsunomiya (JP); Teppei Kurosawa, Utsunomiya (JP)

(73) Assignee: Canon Kabushiki Kaisha, Tokyo (JP)

( * ) Notice: Subject to any disclaimer, the term of this patent is extended or adjusted under 35 U.S.C. 154(b) by 794 days.

(21) Appl. No.: 11/613,931

(22) Filed: Dec. 20, 2006

(65) Prior Publication Data

US 2007/0159427 A1 Jul. 12, 2007

(30) Foreign Application Priority Data

Jan. 6, 2006 (JP) ..... 2006-001493

(51) Int. Cl.
*G09G 3/36* (2006.01)

(52) U.S. Cl. ..... 345/94; 345/209

(58) Field of Classification Search ..... 345/87, 345/94, 209; 348/657, 658, 744, 745, 750, 348/751

See application file for complete search history.

(56) References Cited

U.S. PATENT DOCUMENTS

| | | | | |
|---|---|---|---|---|
| 5,646,646 | A * | 7/1997 | Inoue et al. | 345/684 |
| 6,507,330 | B1 | 1/2003 | Handschy | |
| 6,636,274 | B1 * | 10/2003 | Mazda et al. | 348/745 |
| 6,700,557 | B1 * | 3/2004 | McKnight | 345/87 |
| 7,038,748 | B2 | 5/2006 | Sasaki | |
| 7,564,437 | B2 * | 7/2009 | Yokoyama et al. | 345/87 |
| 2002/0057247 | A1 * | 5/2002 | Lee et al. | 345/88 |
| 2002/0089477 | A1 | 7/2002 | Kanbe et al. | |
| 2002/0105490 | A1 | 8/2002 | Kanbe | |
| 2002/0140653 | A1 | 10/2002 | Koyama | |
| 2002/0149551 | A1 * | 10/2002 | Yamakita et al. | 345/87 |
| 2003/0112213 | A1 * | 6/2003 | Noguchi et al. | 345/96 |
| 2003/0174112 | A1 * | 9/2003 | Jones | 345/94 |
| 2004/0130556 | A1 * | 7/2004 | Nokiyama | 345/617 |
| 2005/0052399 | A1 * | 3/2005 | Hattori et al. | 345/99 |
| 2005/0139829 | A1 * | 6/2005 | Lee | 257/59 |
| 2005/0190172 | A1 * | 9/2005 | Koyama | 345/204 |

FOREIGN PATENT DOCUMENTS

| | | | |
|---|---|---|---|
| JP | 6-250148 | A | 9/1994 |
| JP | 2002-365654 | A | 12/2002 |
| JP | 2005-326843 | A | 11/2005 |

* cited by examiner

*Primary Examiner* — Chanh Nguyen
*Assistant Examiner* — Pegeman Karimi
(74) *Attorney, Agent, or Firm* — Canon USA Inc IP Division

(57) ABSTRACT

A liquid crystal display device includes a liquid crystal modulation element including a first electrode, a second electrode, and a liquid crystal layer, a potential difference providing unit that provides a potential difference between the first electrode and the second electrode, and an illumination optical system that illuminates the liquid crystal modulation element by using light from a light source. The liquid crystal display device includes a charge adjusting mode for reducing the intensity of an electric field generated by electric charge stored between the liquid crystal layer and at least one of the first electrode and the second electrode.

8 Claims, 7 Drawing Sheets

IMAGE DISPLAY DEVICE WITH LIQUID CRYSTAL MODULATION ELEMENTS

BACKGROUND OF THE INVENTION

1. Field of the Invention

The present invention relates to an image display device that modulates light by using liquid crystal modulation elements (liquid crystal display panels or liquid crystal display elements) and that displays images by using modulated light, and more particularly, to a projector display device that projects modulated light.

2. Description of the Related Art

Liquid crystal projectors using liquid crystal modulation elements, which serve as two-dimensional pixel optical switches, as image modulation units of projection display devices, are known. As the liquid crystal modulation elements used for liquid crystal projectors, twisted nematic (TN) liquid crystal elements and vertical arrangement nematic (VAN) liquid crystal elements are mainly used.

The liquid crystal modulation elements provide retardation to light waves passing through a liquid crystal layer to change the polarization condition of the light waves by using the electrically controlled birefringence (ECB) effect, thereby forming image light.

In the liquid crystal modulation elements that modulate the intensity of light by using the ECB effect, since a voltage (electric field or potential difference) is applied to the liquid crystal layer, ionic materials in the liquid crystal layer are migrated. If the application of a direct current (DC) to the liquid crystal layer continues, the ionic materials are attracted to either of the two electrodes opposing each other with the liquid crystal layer therebetween. Then, part of the voltage applied to the liquid crystal layer is canceled by the voltage formed by the ionic materials, which makes it difficult to apply a voltage having a desired intensity level to the liquid crystal layer.

To solve this problem, the following two methods are generally employed. One method is a line inversion drive method in which a voltage is switched at 60 Hz by inverting the polarity of the voltage for every other pixel line, i.e., line by line. The other method is a field inversion drive method in which a voltage is switched at 60 Hz by inverting the polarity of the voltage for every other pixel field, i.e., field by field. By preventing the voltage applied to the liquid crystal layer from being biased to one polarity, the uneven distribution of ionic materials (i.e., the generation of a voltage formed by the ionic materials in the liquid crystal layer) can be prevented.

However, the migration of the ionic materials is not the only reason for the fluctuations of the practical voltage applied to the liquid crystal layer (such a voltage is hereinafter referred to as the "effective voltage"). For example, in a nonconductive film of an insulator (such as a liquid crystal alignment film, a reflection-enhancing film, an inorganic passivation film for preventing metal elution, etc.), electric charge, such as electrons or holes, itself is sometimes trapped. This enhances charging on the interface of the nonconductive film, and this electrostatic charging may change the effective voltage of the liquid crystal layer. With this electrostatic charging, if the above-described liquid crystal modulation elements are driven by one of the above-described inversion drive methods, the difference between the absolute value of a positive potential difference (voltage) and the absolute value of a negative potential difference (voltage) becomes large, causing the occurrence of flicker. That is, the brightness when a positive potential difference is applied and the brightness when a negative potential difference is applied become different from each other, thereby giving rise to a phenomenon where a bright image and a dark image are alternately displayed at a frequency of 60 Hz, i.e., flicker occurs. This phenomenon (flicker) can be observed by the human eye if the difference between the absolute value of the positive potential difference and the absolute value of the negative potential difference becomes 200 mV or higher.

Flicker due to the electrostatic charging occurs when the two electrodes with the liquid crystal layer therebetween are made of the same material (mainly, in transmissive liquid crystal modulation elements), and it is even noticeable when the two electrodes are made of different materials (mainly, in reflective liquid crystal modulation elements).

A solution to the problem of flicker due to electrostatic charging is disclosed in, for example, U.S. Pat. No. 7,038,748. In this publication, a work function adjusting film layer is formed on a reflection pixel electrode, and the work function (Fermi level) of the reflection pixel electrode is set to be ±2% in relation to the work function (Fermi level) of a transparent electrode (indium tin oxide (ITO) film electrode) opposing the reflection pixel electrode. With this configuration, the charging on the interface of the liquid crystal layer can be suppressed, which would otherwise cause flicker or sticking.

More specifically, to allow electric charge to be trapped, excitation hopping of the energy potential of an insulating film between the liquid crystal layer and an electrode is necessary. In the technique disclosed in U.S. Pat. No. 7,038,748, the probability of the occurrence of excitation hopping from the mirror electrode and that from the ITO electrode are set to be close to each other so that the same amount of electric charge is trapped on either side of the liquid crystal layer. With this arrangement, although the voltage applied to the liquid crystal layer by the field inversion drive method shifts as a potential, the magnitude of the voltage remains the same. Accordingly, the voltage applied to the liquid crystal layer is reactively operated by the relative value between the opposing electrodes due to the ECB effect, and the operation of the liquid crystal is not changed.

According to the technique proposed in U.S. Pat. No. 7,038,748, the probability of the occurrence of excitation hopping from the mirror electrode and that from the ITO electrode becomes close, but it is difficult to set the amounts of charging due to excitation hopping to be completely the same. Accordingly, the charging on the interface of the liquid crystal layer gradually increases in accordance with the operating time of the liquid crystal modulation elements. In particular, in terms of the long-term reliability of the liquid crystal modulation elements, i.e., as the driving time of the liquid crystal modulation elements becomes longer, the potential difference between the mirror electrode and the ITO transparent electrode opposing each other reaches several hundreds of millimeter voltages. This phenomenon can be more easily observed as the photon energy input into the liquid crystal modulation elements is higher and as the light-quantity total energy is higher.

Additionally, if the potential difference between the mirror electrode and the ITO transparent electrode is generated due to the charging on the interface of the liquid crystal layer, the following problem occurs. If the application of a constant DC voltage to the liquid crystal layer continues, a minute amount of ionic materials in the liquid crystal layer is attracted to one of or both the interfaces of the liquid crystal layer close to the opposing electrodes. Then, the ions adhering to the interfaces of the opposing electrodes are moved in accordance with the magnitude of the amplitude potential of the field inversion driving, and thus, the amounts of ions adhering to the interfaces of the opposing electrodes become different depending on the magnitude of the amplitude potential. That is, the effective voltage applied to the liquid crystal layer becomes different depending on the position of a display area. This causes a so-called phenomenon "sticking", and after the same image is displayed for a long time, if another image is displayed, the previous image remains as a residual image.

SUMMARY OF THE INVENTION

The present invention provides a liquid crystal display device including a liquid crystal modulation element including a first electrode, a second electrode, and a liquid crystal layer disposed between the first electrode and the second electrode, a potential difference providing unit that provides a potential difference between the first electrode and the second electrode, and an illumination optical system that illuminates the liquid crystal modulation element. The liquid crystal display device includes a charge adjusting mode for reducing the intensity of an electric field generated by electric charge stored between the liquid crystal layer and at least one of the first electrode and the second electrode.

The liquid crystal display device can have a first mode and a second mode, the liquid crystal display device arranged so that when operated in the first mode, a positive voltage and a negative voltage can be alternately applied to the liquid crystal layer in every drive cycle by using the potential difference providing unit while illuminating the liquid crystal modulation element by using the illumination optical system and when operated in the second mode, the liquid crystal display device can be the charge adjusting mode in which a direct current voltage is applied to the liquid crystal layer for a period longer than the drive cycle by using the potential difference providing unit while illuminating the liquid crystal modulation element by using the illumination optical system.

The direct current voltage applied to the liquid crystal layer in the charge adjusting mode can be greater than 200 mV. The charge adjusting mode can be executed during at least one of a start sequence for starting the liquid crystal display device and a stop sequence for stopping the liquid crystal display device. A time for which the charge adjusting mode is continued can be determined based on at least one of an accumulative operation time of the liquid crystal modulation element, an operation environment of the liquid crystal modulation element, and a wavelength of light applied to the liquid crystal modulation element.

The liquid crystal display device can further include an alarm unit that issues an alarm on the basis of a load parameter which is determined based on at least one of an accumulative operation time of the liquid crystal modulation element, an operation temperature environment of the liquid crystal modulation element, and a quantity or a wavelength of light applied to the liquid crystal modulation element.

Furthermore, the drive cycle can be 1/60 seconds or shorter. Also, a time for which the charge adjusting mode is continued can be one second or longer. Moreover, a material for the first electrode can be different from a material for the second electrode. In addition, a Fermi level of the first electrode can be different from a Fermi level of the second electrode.

A thin film composed of an insulating material can be disposed between the liquid crystal layer and each of the first electrode and the second electrode. The liquid crystal modulation element can be a reflective liquid crystal modulation element, and the first electrode and the second electrode can be a transparent electrode and a mirror electrode, respectively.

The present invention also provides a liquid crystal display device including first, second, and third liquid crystal modulation elements corresponding to a first color, a second color, and a third color, respectively, each of the liquid crystal modulation elements including a first electrode, a second electrode, and a liquid crystal layer disposed between the first electrode and the second electrode, first, second, and third potential difference providing units that provide potential differences between the first electrodes and the second electrodes of the first, second, and third liquid crystal modulation elements, respectively, an illumination optical system that illuminates the first, second, and third liquid crystal modulation elements, and a projection optical system that projects image light components from the first, second, and third liquid crystal modulation elements. The liquid crystal display device is operated in a first mode in which a positive voltage and a negative voltage are alternately applied to the liquid crystal layer of each of the first, second, and third liquid crystal modulation elements in every drive cycle by using the potential difference providing unit while illuminating each of the first, second, and third liquid crystal modulation elements by using the illumination optical system and in a charge adjusting mode in which a direct current voltage is applied to the liquid crystal layer of each of the first, second, and third liquid crystal modulation elements for a period longer than the drive cycle by using the potential difference providing unit while applying the light from the light source to each of the first, second, and third liquid crystal modulation elements by using the illumination optical system.

A time for which the charge adjusting mode is continued for each of the first, second, and third liquid crystal modulation elements can be determined based on at least one of an accumulative operation time of the first liquid crystal modulation element, an operation temperature environment of the first liquid crystal modulation element, and a quantity or a wavelength of light applied to the first liquid crystal modulation element.

The liquid crystal display device can further include an alarm unit that issues an alarm on the basis of a load parameter which is determined based on at least one of an accumulative operation time of the first liquid crystal modulation element, an operation environment of the first liquid crystal modulation element, and a wavelength of light applied to the first liquid crystal modulation element.

The liquid crystal display device can further include an alarm unit that issues an alarm on the basis of an output from a sensor that receives at least part of light emitted from the first liquid crystal modulation element.

A time for which the charge adjusting mode is continued for the first liquid crystal modulation element can be different from a time for which the charge adjusting mode is continued for the second liquid crystal modulation element.

According to the present invention, electric charge stored on either side of the liquid crystal layer can be adjusted so that the occurrence of flicking can be suppressed, and it is possible to provide a liquid crystal display device including a liquid crystal modulation element exhibiting high reliability for a long time.

Further features and aspects of the present invention will become apparent from the following description of an exemplary embodiment with reference to the attached drawings.

DESCRIPTION OF THE EMBODIMENTS

Embodiments of the present invention are described in detail below with reference to the accompanying drawings. In this embodiment, a technique for removing or reducing electrons or holes charged on the interfaces of a liquid crystal layer is disclosed so that the effective voltage applied to the liquid crystal layer of a liquid crystal modulation element can be set to be the same voltage as that applied to electrodes. More specifically, a liquid crystal display device is controlled so that the potential difference (voltage) between two electrodes with the liquid crystal layer therebetween becomes substantially equal to that on either side of the liquid crystal layer (the difference between the two voltages is within 400 mV, and more preferably, within 300 mV, and even more preferably, within 200 mV). According to this technique, flicker can be reduced and the life of the liquid crystal modulation elements and the liquid crystal display device can be prolonged. It should be noted that "flicker" in this specification includes, not only flicker that is noticeable to the human eye, but also a small change in the luminance that is unnoticeable to the human eye. A liquid crystal display device of this embodiment is described in detail below.

Figure 1:
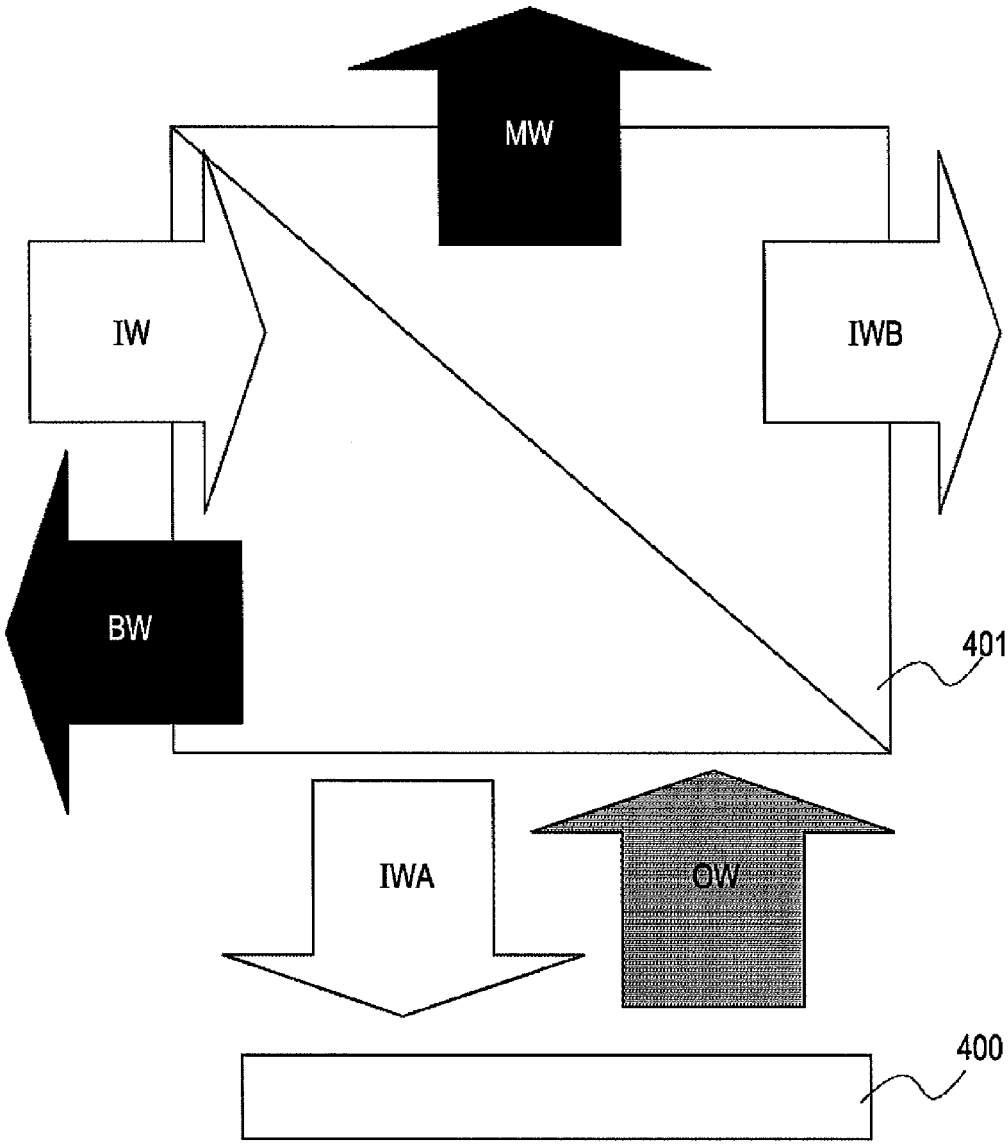
FIG. 1 is a schematic diagram illustrating the operation of a reflective liquid crystal modulation element, according to an aspect of the present invention.

FIG. 1 illustrates a reflective liquid crystal modulation element (a reflective liquid crystal display panel or a reflective liquid crystal display element) 400 of a VAN-liquid-crystal-alignment type and a polarizing beam splitter (PBS) 401 disposed adjacent to the reflective liquid crystal modulation element 400. The operations performed by the reflective liquid crystal modulation element 400 and the polarizing beam splitter 401 are briefly described below with reference to FIG. 1.

Light emitted from a light source is incident on the polarizing beam splitter 401 in the direction indicated by the arrow IW. Then, P-polarized light components pass through a polarizing separation film of the polarizing beam splitter 401 in the direction indicated by the arrow IWB, while S-polarized light components are reflected by the polarizing separation film in the direction indicated by the arrow IWA. The polarizing direction indicated by the arrow IWA is perpendicular to the plane of the drawing, i.e., parallel to the polarizing separation film.

The pretilt angle of the reflective liquid crystal modulation element 400 is 45° relative to the linear polarizing direction indicated by the arrow IWA, and a voltage is applied to the liquid crystal layer so that retardation for an amount equal to a ½ wavelength of the incident light is provided. The light incident on the reflective liquid crystal modulation element 400 in the direction indicated by the arrow IWA is propagated in the liquid crystal layer of the reflective liquid crystal modulation element 400 in two different inherent modes. Then, the light is reflected by the reflective liquid crystal modulation element 400 in the direction indicated by the arrow OW by providing a phase difference $\delta(\lambda)$ represented by equation (1) between the two inherent modes:

$$\delta(\lambda)=2\pi(2d\Delta n)/\lambda \quad (1)$$

where $\lambda$ indicates the wavelength of the incident light, d represents the thickness of the liquid crystal layer, and $\Delta n$ designates the refractive index anisotropy in the state in which a predetermined voltage is applied to the liquid crystal layer. Among the light components emitted from the reflective liquid crystal modulation element 400 in the direction indicated by the arrow OW, light components reflected by the reflective liquid crystal modulation element 400 in the direction perpendicular to the plane of the drawing (i.e., the S-polarized light components with respect to the polarizing beam splitter 401) are reflected by the polarizing separation surface in the direction indicated by the arrow BW and are returned to the light source. In contrast, light components parallel to the plane of the drawing (i.e., the P-polarized light components with respect to the polarizing beam splitter 401) pass through the polarizing separation film in the direction indicated by the arrow MW. If the reflectance of the reflective liquid crystal element 400, and the reflectance of the S-polarized light and the transmittance of the P-polarized light of the polarizing beam splitter 401 are 100%, the light transfer rate (reflectance) $R(\lambda)$ by which the light components are emitted in the direction indicated by the arrow MW can be expressed by equation (2).

$$R(\lambda)=0.5(1-\cos(\delta(\lambda))) \quad (2)$$

The liquid crystal molecules in the liquid crystal layer have a pretilt angle (angle of the liquid crystal molecules with respect to the substrates between which the liquid crystal layer is sandwiched when a voltage is not applied to the liquid crystal layer). If the voltage is applied to the liquid crystal layer, the tilt angle is changed from substantially in the perpendicular direction to substantially in the horizontal direction. Accordingly, the apparent refractive index anisotropy $\Delta n$ is changed. As a result, the phase difference $\delta(\lambda)$ is reduced to be about 0° to 90° ($\delta\approx 0°$ to $\delta\approx 90°$).

Figure 2:
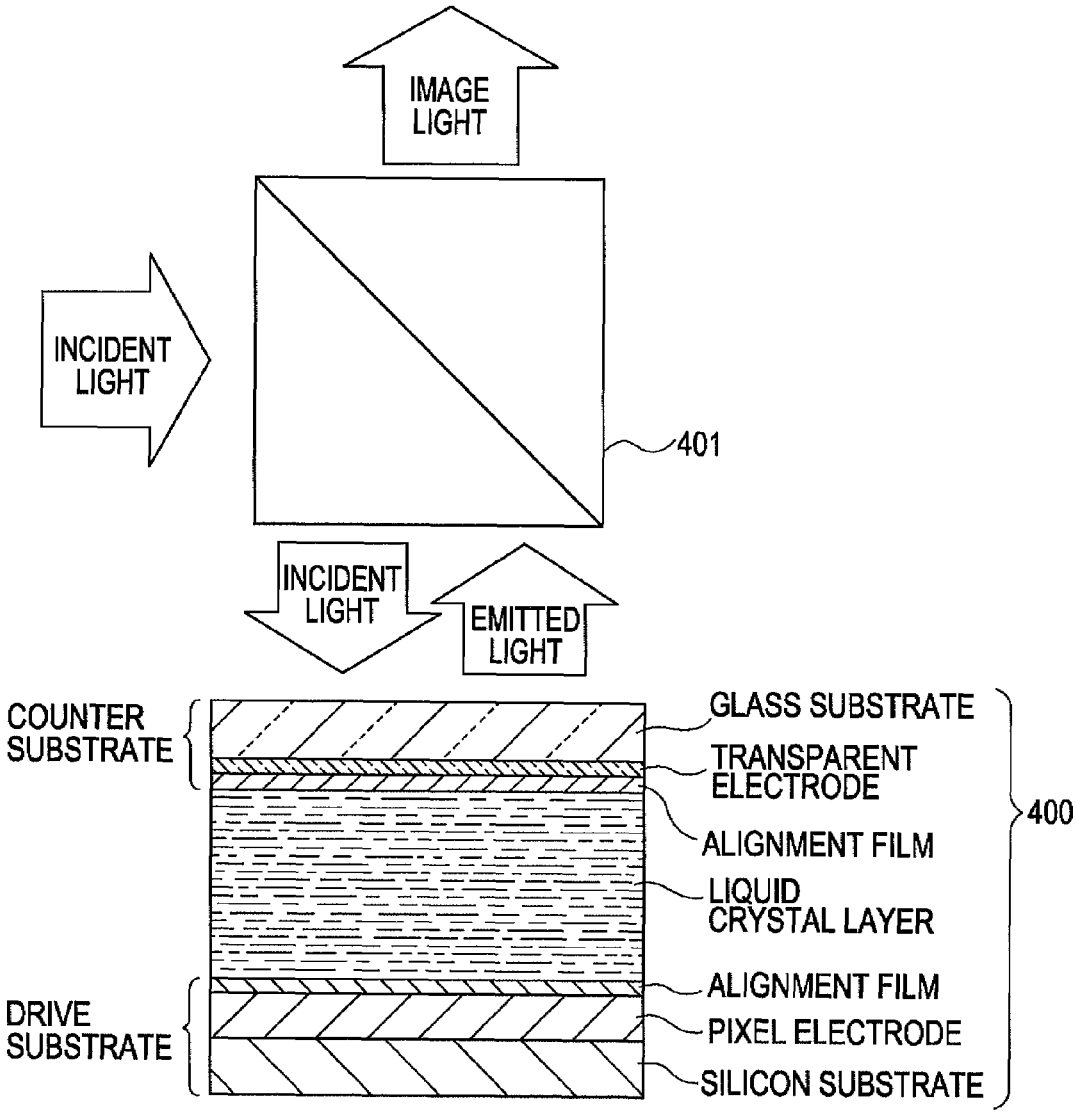
FIG. 2 is a schematic diagram illustrating a liquid crystal modulation element, according to an aspect of the present invention.

The basic internal structure of the reflective liquid crystal modulation element 400 is shown in FIG. 2. The reflective liquid crystal modulation element 400 includes, as shown in FIG. 2, a glass substrate, a transparent electrode (ITO electrode), an alignment film (insulating thin film), a liquid crystal layer, an alignment film, a mirror electrode (pixel electrode) composed of, for example, aluminum (Al), and a silicon (Si) substrate. Although the alignment film is composed of silicon oxide in this example, it may be composed of another insulating material. The mirror electrode may be composed of a material other than Al as long as the material exhibits a reflectance of 85% or greater, and more preferably, 90% or greater, with respect to white light. Alternatively, in association with reflective liquid crystal modulation elements for red, green, and blue colors, mirror electrodes having film layers exhibiting a high reflectance with respect to red light, green light, blue light, respectively, may be used. It should be noted that red light is light having a wavelength from 600 to 660 nm, green light is light having a wavelength from 500 to 560 nm, and blue light is light having a wavelength from 430 to 490 nm.

Figure 3A:
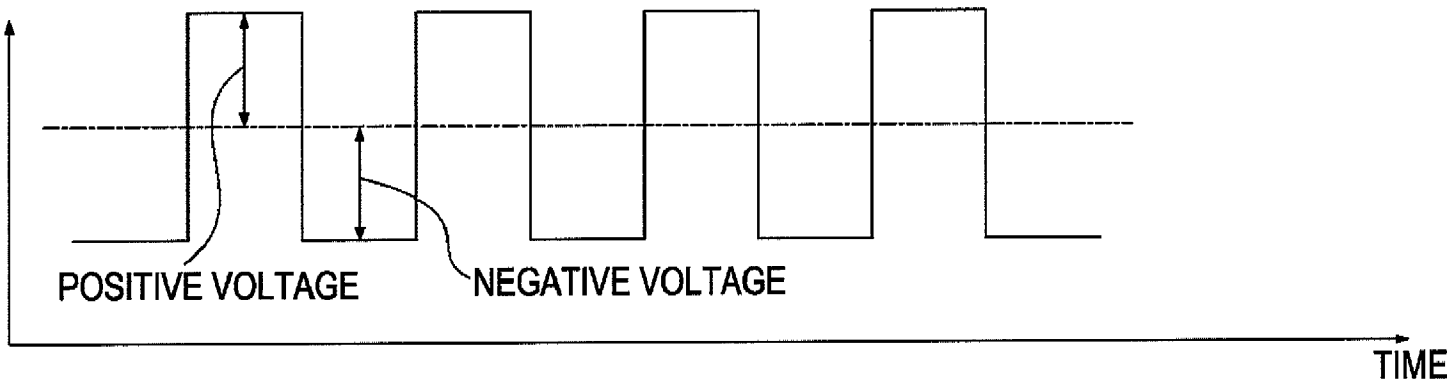
FIGS. 3A and 3B illustrate a potential difference across a liquid crystal layer under a normal condition and that with the occurrence of flickering, respectively, according to an aspect of the present invention.
Figure 3B:
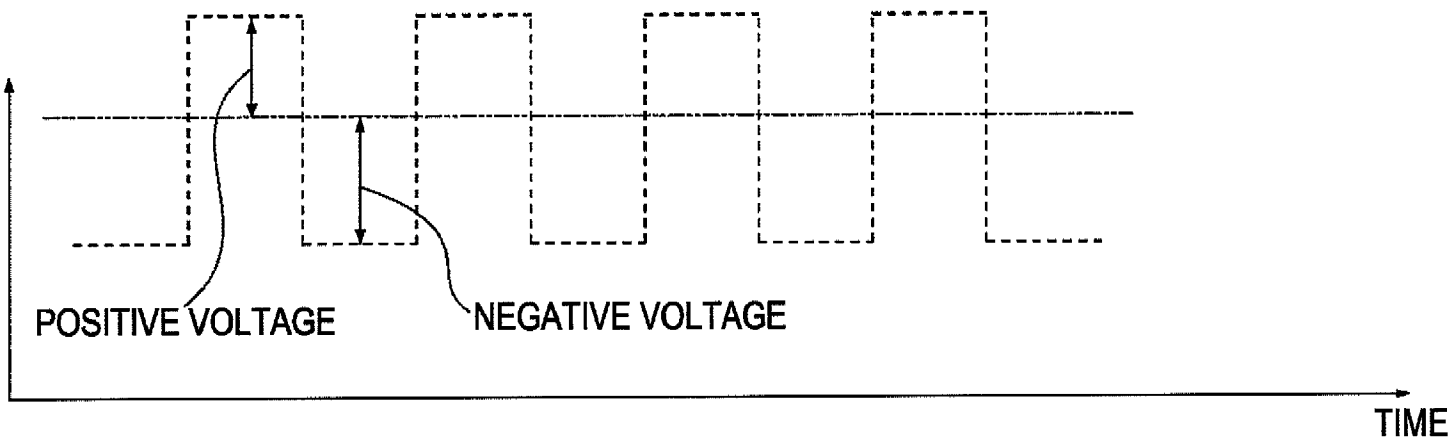

FIGS. 3A and 3B illustrate the potential applied to the mirror electrode and the potential applied to the transparent electrode. In FIGS. 3A and 3B, the vertical axis represents the relative potential applied to the interface of the liquid crystal layer close to the mirror electrode and to the interface of the liquid crystal layer close to the transparent electrode, and the horizontal axis designates the time. The potentials shown in FIGS. 3A and 3B are plotted, assuming that an image signal is a constant signal. However, even if the image signal is a changing signal, this embodiment can be carried out.

FIG. 3A illustrates the potentials in the normal condition, i.e., without the occurrence of flicker. In FIG. 3A, the potential applied to the interface of the liquid crystal layer close to the transparent electrode is indicated by the one-dot-chain line, and the potential applied to the interface of the liquid crystal layer close to the mirror electrode is indicated by the solid lines. In FIG. 3A, the positive potential difference (voltage) and the negative potential difference (voltage) are alternately switched in a predetermined drive cycle (every 1/120 seconds), and the absolute value of the positive potential difference is substantially equal to the absolute value of the negative potential difference. The drive cycle is desirably 1/60 seconds or lower, and more preferably, 1/120 seconds or lower. In the normal condition shown in FIG. 3A, the difference between the positive potential difference and the negative potential difference is 400 mV or smaller, and more preferably, 300 mV or smaller, and even more preferably, 200 mV or smaller. In this example, the image signal is input at 60 Hz, and the positive potential difference is applied to the liquid crystal layer on the basis of the odd-numbered signals, 1, 3, 5, and so on, and the negative potential difference is applied to the liquid crystal layer on the basis of the even-numbered signals, i.e., 2, 4, 6, and so on, so that the liquid crystal display corresponding to the image signal input at 60 Hz can be implemented. The input cycle (reception cycle) of the image signal is referred to as the "predetermined drive cycle".

The method for driving the liquid crystal modulation elements of the liquid crystal display device of this embodiment is briefly discussed below. In the liquid crystal display device of this embodiment, a positive voltage and a negative voltage having the same magnitude are alternately applied to the liquid crystal layer in every cycle of 1/120 second in association with an image signal for each frame (1/60 second cycle) so that an image for two fields is displayed. In this embodiment, as stated above, one frame (1/60 second cycle) corresponds to two fields (two fields form one image in every cycle of 1/120 second). In this case, it is desirable that the absolute value of the positive potential difference applied to the liquid crystal layer in one frame be substantially equal to that of the negative potential difference applied to the liquid crystal layer in the same frame (the difference between the two potential differences is within 400 mV). If the two absolute values are substantially the same, the occurrence of flicker in the liquid crystal modulation elements is suppressed so that flicker becomes unnoticeable to the human eye (not uncomfortable for humans). If the difference between the two absolute values is large, i.e., 250 mV or greater, flicker that can be recognized to the human eye occurs. The liquid crystal modulation elements may be driven such that one frame corresponds to one field, i.e., one frame of an image signal may correspond to 1/60 second, and the positive or negative voltage may be applied to the liquid crystal layer in association with the image signal so that an image for one field can be displayed. If one frame corresponds to one field, it is desirable, as discussed above, that the absolute value of the positive voltage applied to the liquid crystal layer be substantially equal to that of the negative voltage applied to the liquid crystal layer while the image signal remains constant. In this embodiment, it is desirable that the cycle corresponding to one frame (1/60 second) be longer than the cycle corresponding to one field (1/120 second).

FIG. 3B illustrates the potentials when flicker occurs. In FIG. 3B, the potential applied to the interface of the liquid crystal layer close to the transparent electrode is indicated by the two-dot-chain line, and the potential applied to the interface of the liquid crystal layer close to the mirror electrode is indicated by the broken lines. In FIG. 3B, compared with the potentials shown in FIG. 3A, the potential applied to the interface of the liquid crystal layer close to the transparent electrode is shifted relative to the potential applied to the interface of the liquid crystal layer close to the mirror electrode, and the positive potential difference and the negative potential difference are obviously different from each other (the difference between the two potential differences is greater than 400 mV). That is, excitation hopping of electrons or holes occurs unevenly between the transparent electrode and the mirror electrode, and due to the electrons or holes trapped on either side of the liquid crystal layer, a voltage is generated in the liquid crystal layer. In other words, electric charge, such as electrons or holes, within the liquid crystal layer hop out of the liquid crystal layer as a result of being excited by applying light having high intensity to the liquid crystal layer, and may be trapped within the liquid crystal modulation elements. In this case, due to electric charge, such as electrons or holes trapped within the liquid crystal modulation elements, or because of the liquid crystal layer charged due to the hopping of the electric charge, an electric field is generated in the liquid crystal layer in the state in which a voltage is not applied between the electrodes.

If the difference between the positive potential difference and the negative potential difference becomes greater than 400 mV, the difference in the brightness also becomes greater. Then, low frequency components of the light intensity waveforms of flicker at 60 Hz are fluctuated, which makes flicker noticeable even to the human eye.

The energy potential structure and the motions of electrons and holes in the image display state (when an image is displayed, i.e., a first mode) in a reflective liquid crystal modulation element are discussed below with reference to FIG. 4. The image display state is a state in which the reflective liquid crystal modulation element is driven on the basis of an image signal input (read) by an image signal input unit so that an image is displayed. In this case, the reflective liquid crystal modulation element is driven so that the difference between the positive voltage and the negative voltage applied to the interfaces of the liquid crystal layer becomes 400 mV or smaller, and more preferably, 300 mV or smaller, and even more preferably, 200 mV or smaller. The image signal input unit includes a computer, an image storage unit, such as a camera, a video camera, etc., a storage unit, such as a memory, an image receiver, such as a television broadcasting reception antenna, or an image signal receiver that receives an image from such an image input unit.

The reflective liquid crystal modulation element includes an ITO transparent electrode 102 on and from which light is incident and emitted, and a metallic mirror electrode 103 essentially consisting of aluminum or an aluminum alloy, which serves as a mirror surface. In FIG. 4, there are shown a liquid crystal layer 100 and a porous oblique deposition liquid crystal alignment film 101 essentially consisting of silicon oxide for allowing the liquid crystal to be aligned in the form of a VAN. A work-function adjusting film layer 104 is composed of nickel, rhodium, lead, platinum, or an oxide thereof, which exhibits a work function greater than aluminum. Any material may be used for the work-function adjusting film layer 104 as long as the work function of such a material is closer to the material for the ITO transparent electrode 102 than to aluminum, which is the main material for the mirror electrode 103, i.e., as long as the difference in the work function between the work-function adjusting film layer 104 and the ITO transparent electrode 102 is less than 5%.

Figure 4:
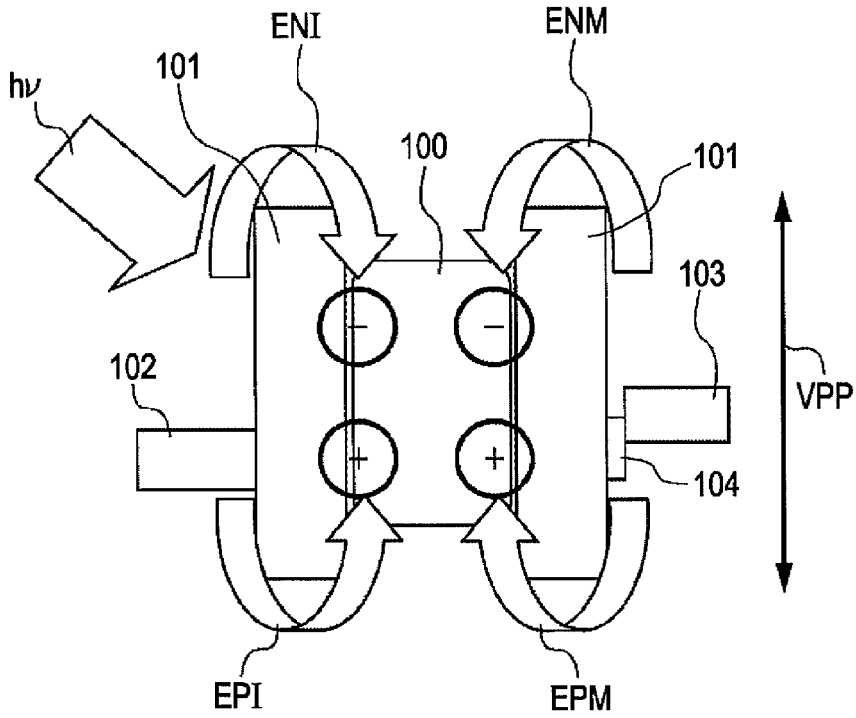
FIG. 4 illustrates a phenomenon in which charging occurs on the surface of the liquid crystal layer of a reflective liquid crystal modulation element, according to an aspect of the present invention.

In FIG. 4, ENI and ENM indicate the excitation of electrons, while EPI and EPM indicate the excitation of holes. ENI and EPI also represent the excitation of electrons and holes from the ITO transparent electrode 102, while ENM and EPM also represent the excitation of electrons and holes from the metallic mirror electrode 103. Also in FIG. 4, hν designates photon energy input into the liquid crystal modulation element, and VPP designates the potential applied to the metallic mirror electrode 103. VPP is applied to the liquid crystal layer as the potential of the field inverting driving (AC components).

The liquid crystal layer 100 to be modulated presents the following basic structure. The liquid crystal layer 100 is disposed such that it is sandwiched between the liquid crystal alignment film 101 composed of silicon oxide, which is an inorganic nonconductive material, and the liquid crystal alignment film 101 with the work-function adjusting film layer 104. The transparent electrode 102 is disposed on the exterior side of the liquid crystal alignment film 101 such that they are in contact with each other, and the metallic mirror electrode 103 is disposed on the exterior side of the work-function adjusting film layer 104 such that they are in contact with each other. The positions of the transparent electrode 102, the metallic mirror electrode 103, and the work-function adjusting film layer 104 in the vertical direction in FIG. 4 indicate the level of the energy potential (Fermi level), and the vacuum level is at the top position in FIG. 4.

The work function energy of the ITO transparent electrode 102 and the work function energy of the metallic (aluminum) mirror electrode 103 from the vacuum level are about 5.0 eV and about 4.2 eV, respectively, i.e., the Fermi levels of the ITO transparent electrode 102 and the metallic mirror electrode 103 are about −5.0 eV and about −4.2 eV, respectively. The work function is the minimum energy needed to remove one electron from the surface of a material into a vacuum (immediately outside the surface of the material), and is a value unique to the material. That is, there is a potential difference of 0.8 eV between the ITO transparent electrode 102 and the metallic (aluminum) mirror electrode 103. Then, the above-described work-function adjusting film layer 104 used in U.S. Pat. No. 7,038,748 is disposed between the metallic (aluminum) mirror electrode 103 and the alignment film 101 to reduce the potential difference between the two electrodes. In this manner, the work-function adjusting film layer (thin film layer) 104 is formed so that the work function of the metallic mirror electrode 103 becomes closer to that of the ITO transparent electrode 102, and then, the probability that electrons and holes are excited from the metallic mirror electrode 103 is substantially equal to that from the ITO transparent electrode 102.

Ideally, the energy potential difference between the metallic mirror electrode 103 and the ITO transparent electrode 102 becomes zero. Even with the use of the work-function adjusting film layer 104, however, the potential difference between the two electrodes is probably greater than zero and smaller than 0.2 eV. This is because it is practically difficult to set the potential difference between the two electrodes to be exactly the same due to limitations of the materials that can be used for the work-function adjusting film layer 104 and due to variations in the manufacturing conditions and process.

Figure 6:
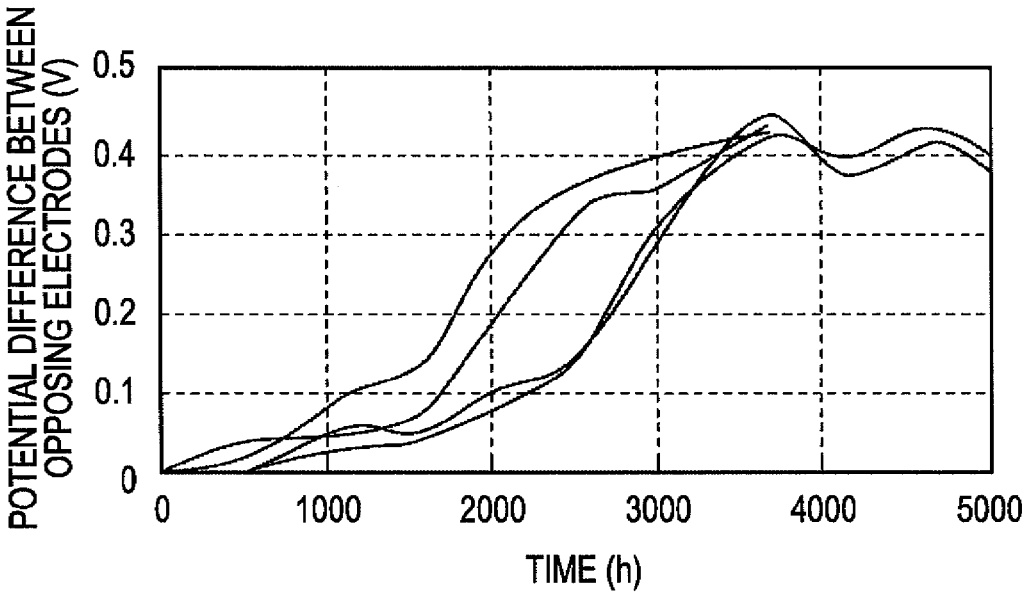
FIG. 6 is a graph as a result of a test when charging occurs on the surface of the liquid crystal layer of a reflective liquid crystal modulation element, according to an aspect of the present invention.

FIG. 6 is a graph illustrating the potential differences between opposing electrodes over time when a long-term test was conducted on four liquid crystal modulation elements having work-function adjusting film layers. Although there are some variations in the characteristics of the liquid crystal modulation elements due to the variations in the manufacturing process for the work-function adjusting film layers, the potential differences of some test samples exceed 200 mV after the operation time of about 2000 hours. After the operation time of about 3000 hours, the potential differences of all the test samples exceed 200 mV. In excess of the potential difference of 200 mV, flicker becomes noticeable, and the sticking characteristic is seriously deteriorated from the initial performance. The "sticking" is a phenomenon where an electric field for displaying an image of the previous frame remains, and due to the residual DC voltage, the previous image is overlaid as a residual image on an image of the subsequent frame. If flicker is intensified, a high level of voltage is applied in the positive direction or in the negative direction, and the voltage in the reverse direction becomes weak, thereby increasing the possibility of the occurrence of sticking (deteriorating the sticking characteristic). The "potential difference between the opposing electrodes" indicates the potential difference of the ITO transparent electrode relative to the potential difference of the mirror electrode in the state in which a voltage is not applied between the opposing electrodes (i.e., a voltage at 0 volts is applied). The potential difference of 200 mV in FIG. 6 is equal to 400 mV, which is two times as large as 200 mV, in terms of the difference between the positive voltage and the negative voltage in FIG. 3B. This can be easily understood if it is assumed that the potential of the ITO transparent electrode is shifted to the positive or negative direction by 200 mV from the state shown in FIG. 3A (the state without occurrence of flicker).

Accordingly, the degree of flicker that is noticeable to the human eye can be represented by a potential difference greater than 400 mV in terms of the difference between the positive voltage and the negative voltage. Alternatively, it can be represented by a potential difference greater than 200 mV in terms of the potential difference between the opposing electrodes. Accordingly, if the potential difference between the opposing electrodes exceeds 200 mV, it can be considered that the life of the liquid crystal modulation elements has been reached.

In this embodiment, therefore, the liquid crystal modulation element is driven in the following manner so that noticeable flicker can be suppressed, i.e., the occurrence of noticeable flicker is delayed. The method for implementing this is specifically discussed below with reference to FIG. 5.

Figure 5:
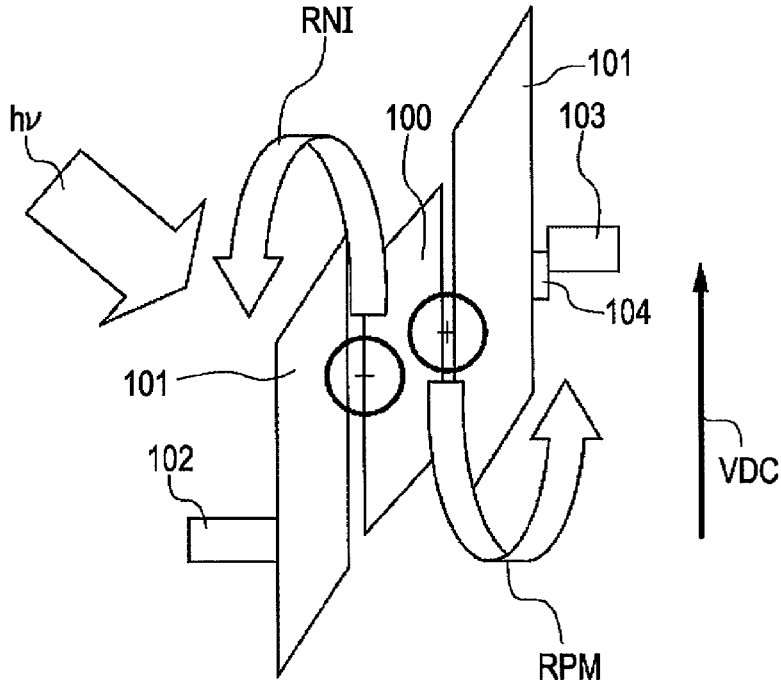
FIG. 5 illustrates a technique for controlling the amount of charging on the surface of the liquid crystal layer of a reflective liquid crystal modulation element according to an embodiment of the present invention.

The structure shown in FIG. 5 is the same as that in FIG. 4. As indicated by the arrow shown in FIG. 5, a DC voltage VDC is applied to the liquid crystal layer 100 (between the opposing electrodes) for a time longer than the drive cycle (1/60 seconds if the drive frequency is 60 Hz). The DC voltage does not have to be a constant voltage, and even if the magnitude of the voltage (the value of the voltage or the potential difference) is changed, it can be referred to as a DC voltage as long as the sign of the voltage remains the same. It should also be noted that the effective voltage applied to the liquid crystal layer 100 is referred to as the "DC voltage". The time for which the DC voltage is applied is preferably more than 10 times, and more preferably, more than 1000 times, and even more preferably, more than 10000 times, as long as the drive cycle (1/60 seconds).

That is, a potential is provided between the opposing electrodes for a time longer than the drive cycle so that the voltage applied to one electrode always becomes positive and the voltage applied to the other electrode always becomes negative. This facilitates the motion of the electrons and holes, as shown in FIG. 5, and more specifically, the electrons are migrated to the bottom left side of the drawing, i.e., toward the ITO transparent electrode 102, while the holes are migrated to the top right of the drawing, i.e., toward the metallic mirror electrode 103.

As a result, since the electrons and holes trapped on either side of the liquid crystal layer 100 are removed (reduced), the voltages generated by the trapped electrons and holes can be eliminated (reduced). That is, the amounts of electrons and holes charged between the liquid crystal layer 100 and the electrodes are adjusted (reduced) so that the difference in the potential difference between the interfaces of the liquid crystal layer 100 generated due to the electrons and holes charged between the liquid crystal 100 and the electrodes can be reduced.

This is described in greater detail. If the photon energy (light) hv continues being input into the liquid crystal modulation element while the DC voltage VDC is being applied, the following phenomenon occurs. Electrons trapped near the interface between the liquid crystal layer 100 and the liquid crystal alignment film 101 are forcibly excited by the light and are drained toward the transparent electrode 102, as indicated by the arrow RNI, due to the gradient of the energy level caused by the application of the voltage. Also, holes trapped near the interface between the liquid crystal layer 100 and the liquid crystal alignment film 101 are forcibly excited by the light and are drained toward the mirror electrode 103, as indicated by the arrow RPM, due to the gradient of the energy level caused by the application of the voltage. If the polarities of the DC voltage applied to the interfaces of the liquid crystal layer 100 close to the transparent electrode 102 and the mirror electrode 103 are reversed, the potential difference of the interface of the liquid crystal layer 100 close to the transparent electrode 102 and that close to the mirror electrode 103 are reversed.

Figure 7:
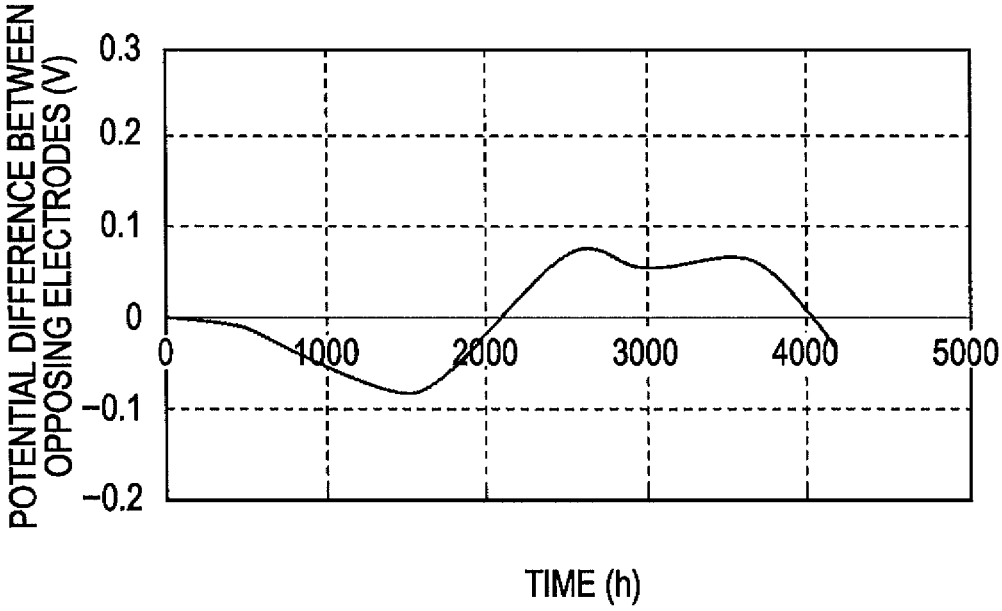
FIG. 7 is a graph as a result of a test when a technique for controlling the amount of charging that has occurred on the surface of the liquid crystal layer of a reflective liquid crystal modulation element is used according to an embodiment of the present invention.

The result of the long-term operation test conducted by using the above-described method is shown in FIG. 7. In this test, after an interval in which a liquid crystal modulation element was operated at 50° C. for four hours, a predetermined voltage (potential difference of 3 V between opposing electrodes) was applied to the liquid crystal modulation element while a predetermined quantity of light (about 3 W/cm$^2$ of blue light) was being input into the liquid crystal modulation element. In FIG. 7, the vertical axis represents the potential difference between the opposing electrodes of the liquid crystal modulation element, and the horizontal axis designates the time. FIG. 7 shows that the potential difference between the opposing electrodes does not exceed 200 mV and is contained within ±100 mV even after the operation time of about 4000 hours. That is, according to this embodiment, it has been proved that the occurrence of flicker or sticking can be suppressed for a long period.

In this long-term operation test shown in FIG. 7, after the driving in the image display state (first mode) for four hours, driving in a charge adjusting mode (second mode, i.e., image non-display mode, though images may be displayed during this mode) in the form of a "charge removing mode" was conducted for five minutes. The charge removing mode is a mode in which electrons and holes trapped on either side of the liquid crystal layer 100 are removed (or the charge stored in one interface of the liquid crystal layer 100 and the charge stored in the other interface are balanced so that the voltage applied to the liquid crystal layer 100 is eliminated). Although, in the charge removing mode in the above-described test, the voltage of 3 V was applied across the liquid crystal layer 100, it is sufficient if a voltage of 200 mV or higher, and more preferably, 500 mV or higher, and even more preferably, 1 V or higher, is applied. Additionally, although the voltage application time was five minutes (which is 72000 times as long as the driving cycle (1/120 second)) in the above-described test, the application time may be one second (which is 120 times as long as the driving cycle) or longer, and more preferably, 10 seconds or longer, and more preferably, one minute or longer. It is desirable that the continuation time for the charge removing mode (second mode) is 1/500 or longer, and more preferably, 1/100 or longer, and even more preferably, 1/50 or longer, the continuation time for the image display mode (first mode).

It is desirable, however, that the continuation time for the charge removing mode for removing the charges of electrons and holes trapped near the interfaces between the liquid crystal layer 100 and the liquid crystal alignment films 101 be determined based on the following factors: the operation conditions of the liquid crystal modulation element, such as the accumulative operation time in the first mode, the operation environments, such as the temperature, humidity, etc., in the first mode, and the accumulated quantity of light or the light wavelength in the first mode. It is desirable that the continuation time for the charge removing mode be determined in accordance with a parameter (load parameter) based on at least one of those factors. This load parameter may be indicated by the time, such as the continuation time Te necessary for the charge removing mode, or another unit. If the continuation time for the charge removing mode is empirically predetermined, the predetermined continuation time may be stored, and then, the charge removing mode may be performed in the image non-display state. The image non-display state is a state in which an image display function is not operated even when power is supplied to an image display device, i.e., in the standby mode.

The continuation time for the charge removing mode may be determined by using a detection result of an optical sensor. For example, an optical sensor at a position indicated by reference numeral 50 in FIG. 8, may be disposed, and the continuation time may be determined in accordance with a change in the quantity of light incident on the optical sensor. If the optical sensor is installed at this position, part of the light emitted from all liquid crystal modulation elements 2R, 2G, and 2B of three colors can be detected. Accordingly, the amounts of light for three colors can be detected with one optical sensor.

The use of an optical sensor makes it possible to measure a change in the quantity of light in accordance with the amount of charged electrons and holes, thereby implementing more precise charge removing. It is sufficient if the sensor 50 detects the quantities of red, green, and blue light components, and it is more preferable, however, that the sensor 50 individually controls the modulation of light of each color to separately measure a change in the quantity of light applied to a liquid crystal modulation element of each color. With this arrangement, it is possible to determine the suitable continuation time for the charge removing mode employed for a liquid crystal modulation element of each color in accordance with the quantity of electrons or holes of the corresponding liquid crystal modulation element.

Alternatively, after determining the continuation time for the charge removing mode of each liquid crystal modulation element, the continuation time for the charge removing mode for a liquid crystal modulation element for a green color which exhibits the highest relative luminosity factor may be set as the continuation time for the charge removing mode for all the liquid crystal modulation elements. Alternatively, the continuation time for the charge removing mode may be different among the liquid crystal modulation elements. Additionally, an alarming unit for issuing an alarm based on the output of the optical sensor 50 may be disposed so that the user's attention can be aroused.

It is desirable that an optical sensor be disposed within the liquid crystal display device. However, it may be disposed outside the liquid crystal display device, in which case, the continuation time for the charge removing mode may be determined by using the detection result obtained by the optical sensor. The position at which the optical sensor is located is not restricted to the position indicated by reference numeral 50 shown in FIG. 8, and the optical sensor may be disposed on the wall surface of a projection optical system, or a movable optical sensor may be used so that it can be moved on the light path while the charge removing mode is being performed.

As described above, the use of an optical sensor makes it possible to detect unnoticeable flicker (and more specifically, to measure the potential difference smaller than 200 mV generated by electrical charge stored across the liquid crystal layer), thereby achieving suitable and precise charge removal.

The charge removing mode can be started when the liquid crystal display device is started or stopped. Alternatively, the charge removing mode may be started by a manual operation, for example, a button operation performed by the user.

If the driving in the charge removing mode is necessary for long hours, the time for the charge removing mode may be divided into several times. If, for example, about one hour is required for the driving in the charge removing mode, it may be divided into twenty times, each being performed for three minutes, by utilizing the time for starting or stopping the liquid crystal display device. Additionally, if the operator manually performs the charge removing mode, he/she can use a charge removing mode start button (image display stop button) and a charge removing mode stop button (image display restart button) to perform the charge removing mode for a predetermined time. The application of a DC voltage in the charge removing mode (second mode) is discussed below. It is now assumed that image display is continued while the potential difference of the ITO transparent electrode is maintained at a constant level and the center potential difference of the pixel electrode is adjusted to the potential difference of the ITO transparent electrode. Under this condition, the case where the ideal potential difference of the ITO transparent electrode that can minimize the level of flicker is monotonously changed in the positive direction is considered. In this case, it is sufficient if the potential difference of the ITO transparent electrode is not changed in the negative direction.

In this case, in the above-described charge removing mode, a voltage should be applied to the liquid crystal layer in the state in which the potential of the ITO transparent electrode is set in the negative direction relative to the center potential difference of the pixel electrode. Conversely, under the same condition, the case where the ideal potential difference of the ITO transparent electrode that can minimize the level of flicker is monotonously changed in the negative direction is considered. In this case, in contrast to the previous case, in the above-described charge removing mode, a voltage should be applied to the liquid crystal layer in the state in which the potential of the ITO transparent electrode is set in the positive direction relative to the center potential difference of the pixel electrode. According to the execution of the charge removing mode described above, the influence of electric charge (electrons or holes) trapped within the liquid crystal modulation elements on the liquid crystal layer can be reduced, and thus, the occurrence of flicker can be suppressed.

The procedure for performing the charge removing mode in accordance with the start operation (start sequence) of an image display device is described below with reference to the flowchart in FIG. 9. The start operation (start sequence) represents the operation from when the image display device is powered ON until when an image is displayed. Conversely, the stop operation (stop sequence) indicates the operation from when the image display device is powered OFF until when a cooling fan of the image display device is stopped.

In step S101, the image display device is powered ON. Then, in step S102, the start operation is immediately performed. With the lapse of a required time Tn after the start operation, in step S109, the start operation is finished. Simultaneously with the execution of the start operation, the charge removing mode is started, and the following operation is performed. The continuation time Te necessary for the charge removing mode (charge-removing-mode necessary continuation time) obtained on the basis of the operation condition of the liquid crystal modulation element is read from the memory, and it is determined in step S103 whether the continuation time Te is greater than zero. If the continuation time Te is smaller than or equal to zero, the process proceeds to step S110 in which the charge removing mode is finished. If the continuation time Te is found to be greater than zero, the process proceeds to step S104 to determine whether the continuation time Te is greater than the time Tn necessary for the start operation (start operation necessary time). If time Te is found to be greater than time Tn, the process proceeds to step S105 in which the charge removing mode is performed for Tn. After the lapse of Tn, in step S106, the difference between Te and Tn is calculated, and the calculation result is stored in the memory as the new charge-removing-mode necessary continuation time Te. If Te is found to be smaller than or equal to Tn in step S104, the process proceeds to step S107 in which the charge removing mode is performed for the charge-removing-mode necessary continuation time Te. Then, in step S108, Te is updated to zero and is stored in the memory. The charge removing mode is then finished in step S110.

Figure 9:
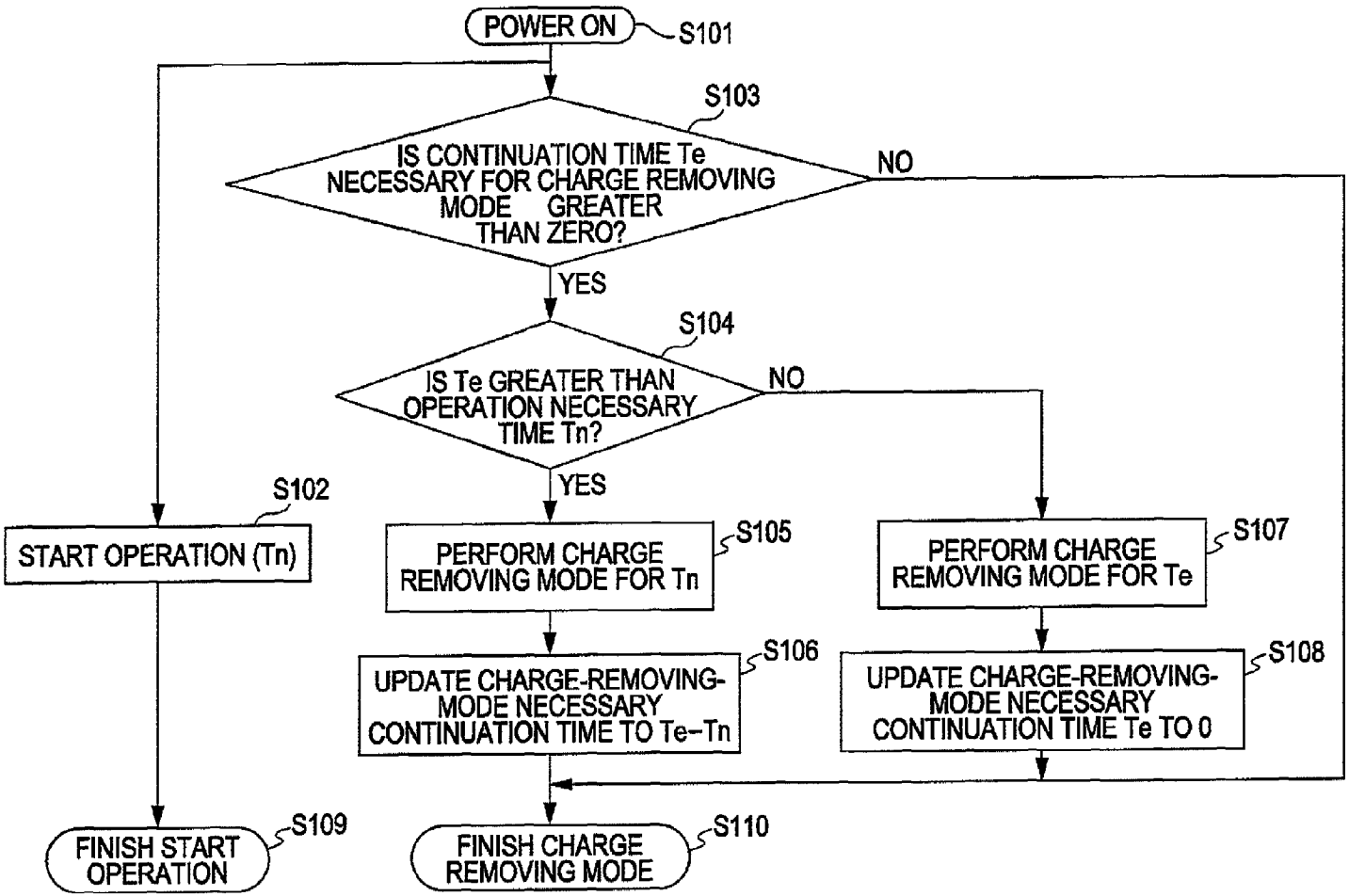
FIG. 9 is a flowchart illustrating a procedure for performing a charge removing mode according to an embodiment of the present invention.

The procedure indicated by the flowchart shown in FIG. 9 is an example only, and the charge removing mode may be performed by a different procedure. For example, the charge removing mode is performed while the start operation is being performed. In this case, in response to a signal indicating that the charge-removing-mode execution time exceeds the charge-removing-mode necessary continuation time Te or that the start operation has been finished (or is to be finished soon), the charge removing mode is finished. Then, the difference between the charge-removing-mode execution time Tex and the charge-removing-mode necessary continuation time Te is calculated and is stored in the memory as the new charge-removing-mode necessary continuation time Te. This procedure is more effective for removing charge in a case where the actual start operation time becomes longer than the usual start operation time.

In the procedure shown in FIG. 9, the charge removing mode is started when the device is powered ON. However, it may be started when the device is stopped or when a predetermined button, e.g., a charge-removing-mode start button or a flicker-eliminating button, is pressed. Alternatively, when the charge-removing-mode necessary continuation time Te (may be simply a load parameter instead of the time) obtained on the basis of the operation condition of the device reaches a predetermined value (e.g., 30 minutes or one hour), the charge removing mode may be forcibly started. Alternatively, before Te reaches the above-described predetermined value, the device may be operated in the image display mode for a short while, and then, an alarm indicating that the charge removing mode is forcibly started may be issued. If the charge removing mode is not performed, the remaining time until the end of the life of the device (i.e., the time before the occurrence of flicker) may be displayed.

When performing the charge removing mode (or performing control for removing charge), a light-shielding unit, such as a shutter, for shielding light from leaking to the outside the device may be mechanically or electrically disposed. If the operation time of the charge removing mode is different among the liquid crystal modulation elements, light-shielding units for independently shielding light of the individual colors may be disposed in an illumination optical system. Alternatively, another light source used for the charge removing mode may be provided for each liquid crystal modulation element, and the liquid crystal modulation element may be illuminated by using the light source when the charge removing mode is performed. With this configuration, a light-shielding unit provided for the above-described illumination optical system becomes unnecessary.

Figure 8:
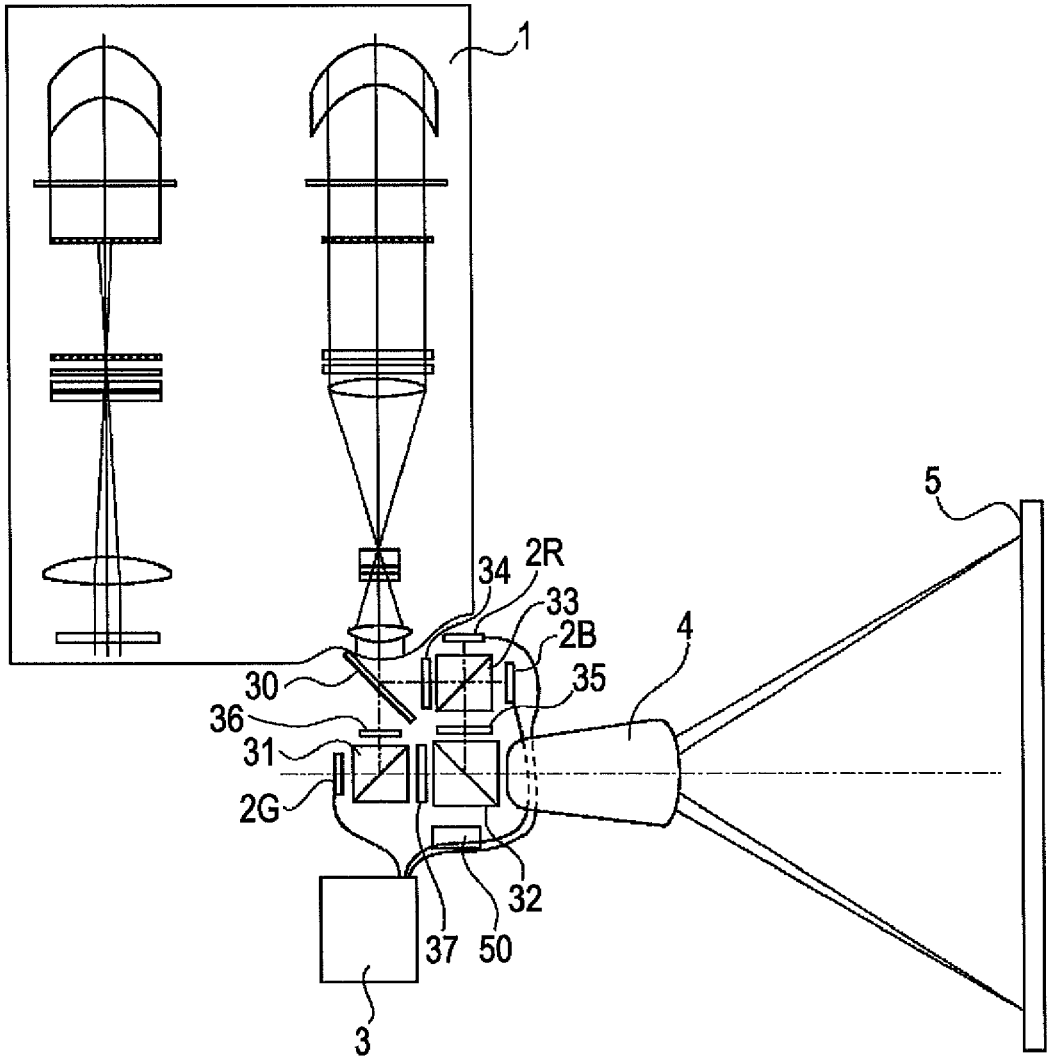
FIG. 8 is a schematic view illustrating a projection display device using reflective liquid crystal modulation elements according to an embodiment of the present invention.

FIG. 8 is a sectional view illustrating an exemplary main optical system of a projection display device according to an embodiment of the present invention. Three reflective liquid crystal modulation elements 2R, 2G, and 2B are independently controlled by using a drive signal output from an optical modulation panel driver (controller) 3 that converts an image signal supplied from an image signal input unit (not shown) into an optical modulation panel drive signal.

A dichroic mirror 30 receives illumination light which is output from an illumination unit (illumination optical system) 1 (the side view of which is shown in FIG. 1) and which is linearly polarized in the direction perpendicular to the plane of the drawing, and separates the illumination light by reflecting red light and blue light and by transmitting green light. In this illumination unit 1, the optical arrangement is different between the light from the light source in cross section perpendicular to the plane of the drawing (cross section including the light axis of the illumination optical system) and that in cross section parallel to the plane of the drawing. That is, an illumination light beam incident on the dichroic mirror 30 is integrated in cross section perpendicular to the plane of the drawing, and is not integrated in cross section parallel to the plane of the drawing. This embodiment is applicable to an illumination unit in which the illumination light beam incident on a dichroic mirror is integrated both in cross sections.

A blue cross color polarizer 34 is disposed on the common light path for red light and blue light to provide half-wavelength retardation to blue light and not to provide retardation to red light. The blue cross color polarizer 34 is a wavelength-selecting $\lambda/2$ panel and is an optical element that functions as a $\lambda/2$ panel for blue light and that does not provide a phase difference for red light or green light. As a result, the polarizing direction of blue light is parallel to the plane of the drawing, and the polarizing direction of red light remains perpendicular to the plane of the drawing, and the blue light and red light in those states are incident on a beam splitter 33. Then, the blue light, which is linearly polarized in the direction parallel to the plane of the drawing, passes through the polarizing separation film since it is P-polarized light with respect to the polarizing separation film, and is led to the blue-light reflective liquid crystal modulation element 2B, which serves as a blue-light modulation panel. The red light is reflected by the polarizing separation film since it is S-polarized light with respect to the polarizing separation film, and is led to the red-light reflective liquid crystal modulation element 2R, which serves as a red-light modulation panel. Light components, which serve as image light, are provided with half-wavelength retardation by the corresponding light modulation panels and are output from the light modulation panels, and are again incident on the polarizing beam splitter 33. As a result, the image light (P-polarized red light and S-polarized blue light) emitted from the red-color and blue-color light modulation panels is led toward the bottom side in the plane of the drawing, and is incident on a red cross color polarizer 35 that provides half-wavelength retardation to the red light and does not provide retardation to the blue light. As in the above-described blue cross color polarizer 34, the red cross color polarizer 35 is a wavelength-selecting $\lambda/2$ panel and is an optical element that functions as a $\lambda/2$ panel for red light and that does not provide a phase difference to blue light or green light. In this manner, after being entirely converted into S-polarized light, the red and blue light components are incident on a polarizing beam splitter 32 and are reflected by the polarizing separation surface. The reflected light components are then led to a projection optical system 4 and are projected on a screen (projector surface) 5.

Green light passing through the dichroic mirror 30 passes through a dummy glass 36 for adjusting the light path length (which may be a polarizer which transmits only S-polarized light for adjusting the polarization state) and is incident on a polarizing beam splitter 31. The green light is reflected by the polarizing separation surface since it is S-polarized light with respect to the polarizing separation surface, and is incident on the green-light reflective liquid crystal modulation element 2G, which serves as a green-light modulation panel, and light components, which serve as image light, are provided with half-wavelength retardation. As a result, the green image light is emitted as P-polarized light and passes through the polarizing beam splitter 31 and a dummy glass 37 for adjusting the light path length (which may be a polarizer which transmits only P-polarized light for adjusting the polarization state). Then, the green image light passes through the polarizing beam splitter 32 and is projected on the screen 5 by the projection optical system 4.

In this embodiment, a reflective liquid crystal modulation element in which a liquid crystal layer is sandwiched between a transparent electrode and a mirror electrode has been described by way of example. However, a transmissive liquid crystal modulation element may be used since the above-described problem occurs due to the configuration of the electrodes. Although a VAN liquid crystal modulation element is used in this embodiment, another type of liquid crystal modulation element, such as a TN liquid crystal modulation element, may be employed.

In this embodiment, the ECB driving is performed so that substantially an AC voltage is applied to the liquid crystal layer by applying a constant potential to the transparent electrode and by applying a vertically shifting potential (having pseudo-AC components) to the mirror electrode. The potentials applied to the transparent electrode and the mirror electrode may be reversed.

In this embodiment, while an image is being displayed on the basis of an image signal, the liquid crystal modulation element is driven under the normal condition without performing an operation for removing electrons or holes. However, the present invention is not restricted to this mode. More specifically, for removing electrons or holes, the potential of the transparent electrode and/or the mirror electrode may be adjusted to such a degree not to cause flicker while an image is being displayed on the basis of an image signal. That is, a constant potential may be applied to the transparent electrode and/or the mirror electrode (a very small bias voltage may be applied to the liquid crystal layer) while an image is being displayed. Then, electrons and holes trapped on either side of the liquid crystal layer can be removed (or reduced) while an image is being displayed.

Although in this embodiment only an alignment film is disposed between the liquid crystal layer and an electrode, another film may be disposed in addition to the alignment film.

In this embodiment, the reason for using terms "the potential applied to the interface of the liquid crystal layer close to the transparent electrode" and "the potential applied to the interface of the liquid crystal layer close to the mirror electrode" is that the voltage applied to the liquid crystal layer is not always equal to that of the transparent electrode or the mirror electrode since a voltage drop is likely to occur due to the presence of a film (alignment film) disposed between the liquid crystal layer and the transparent electrode or the mirror electrode. In this embodiment, therefore, term "the potential difference between the transparent electrode and the mirror electrode" actually means the above-described terms. If a film, such as an alignment film, is not necessary between the liquid crystal layer and the transparent electrode or the mirror electrode, the potential applied to the interface of the liquid crystal layer close to the transparent electrode can be read as the potential of the transparent electrode, and the potential applied to the interface of the liquid crystal layer close to the mirror electrode can be read as the potential of the mirror electrode.

In this embodiment, a projector image display device (projector) is used by way of example. However, another type of device, such as a direct-view-type liquid crystal image display device, may be used.

While the present invention has been described with reference to an exemplary embodiment, it is to be understood that the invention is not limited to the disclosed exemplary embodiment. The scope of the following claims is to be accorded the broadest interpretation so as to encompass all modifications, equivalent structures and functions.

This application claims the benefit of Japanese Application No. 2006-001493 filed Jan. 6, 2006, which is hereby incorporated by reference herein in its entirety.

What is claimed is:

1. A liquid crystal display device comprising:

a liquid crystal modulation element including a first electrode, a second electrode, and a liquid crystal layer disposed between the first electrode and the second electrode;

a potential difference providing unit that provides a potential difference between the first electrode and the second electrode; and an illumination optical system that illuminates the liquid crystal modulation element, wherein the liquid crystal display device has a first mode and a second mode, the liquid crystal display device arranged so that when operated in the first mode, the liquid crystal display device applies a positive voltage corresponding to one field and a negative voltage corresponding to one field alternately to the liquid crystal layer for each drive cycle corresponding to an image signal of one frame by using the potential difference providing unit while illuminating the liquid crystal modulation element by using the illumination optical system, and when operated in the second mode, the liquid crystal display device applies a direct current voltage to the liquid crystal layer for a period longer than 10 seconds, wherein a period of time for applying the direct current voltage is longer than ten times the drive cycle, wherein the liquid crystal modulation element is a reflective liquid crystal modulation element, and the first electrode and the second electrode are a transparent electrode and a mirror electrode, respectively, wherein the second mode is executed after the liquid crystal display device is powered OFF.

2. The liquid crystal display device according to claim 1, wherein a direct current voltage applied to the liquid crystal layer in the second mode is greater than 200 mV.

3. The liquid crystal display device according to claim 1, wherein a time for which the second mode is continued is determined based on at least one of an accumulative operation time of the liquid crystal modulation element, an operation environment of the liquid crystal modulation element, and a wavelength of light applied to the liquid crystal modulation element.

4. The liquid crystal display device according to claim 1, further comprising an alarm unit that issues an alarm on the basis of a load parameter which is determined based on at least one of an accumulative operation time of the liquid crystal modulation element, an operation temperature environment of the liquid crystal modulation element, and a quantity or a wavelength of light applied to the liquid crystal modulation element.

5. The liquid crystal display device according to claim 1, wherein a drive cycle is 1/60 seconds or shorter.

6. The liquid crystal display device according to claim 1, wherein a Fermi level of the first electrode is different from a Fermi level of the second electrode.

7. The liquid crystal display device according to claim 1, wherein a thin film composed of an insulating material is disposed between the liquid crystal layer and each of the first electrode and the second electrode.

8. The liquid crystal display according to claim 1, wherein, in the second mode, the direct current voltage is applied to the liquid crystal layer in a state in which a potential of the transparent electrode is set in a positive direction relative to a center potential of the pixel electrode, in a case where an ideal potential of the transparent electrode that minimizes a level of flicker is monotonously changed in a negative direction, when an image continues to be displayed in a state in which the potential of the transparent electrode is maintained constant and the center potential of the pixel electrode corresponds to the potential of the transparent electrode.

* * * * *